US010280021B2

(12) United States Patent
Hirano

(10) Patent No.: US 10,280,021 B2
(45) Date of Patent: May 7, 2019

(54) FEEDING APPARATUS

(71) Applicant: CANON KABUSHIKI KAISHA, Tokyo (JP)

(72) Inventor: Yuya Hirano, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/920,969

(22) Filed: Mar. 14, 2018

(65) Prior Publication Data

US 2018/0267451 A1 Sep. 20, 2018

(30) Foreign Application Priority Data

Mar. 17, 2017 (JP) ..... 2017-053523

(51) Int. Cl.
*B65H 7/06* (2006.01)
*G03G 15/00* (2006.01)
(Continued)

(52) U.S. Cl.
CPC ..... *B65H 7/06* (2013.01); *B65H 3/5261* (2013.01); *B65H 5/062* (2013.01); *B65H 7/14* (2013.01); *G03G 15/5012* (2013.01); *G03G 15/6558* (2013.01); *G03G 15/70* (2013.01); *B65H 2511/528* (2013.01); *B65H 2513/11* (2013.01); *B65H 2513/50* (2013.01); *B65H 2601/11* (2013.01); *B65H 2601/255* (2013.01);
(Continued)

(58) Field of Classification Search
CPC ..... B65H 3/5261; B65H 5/062; B65H 7/06; B65H 7/14; B65H 7/00; B65H 3/062; B65H 2511/528; B65H 2513/11; B65H 2513/50; B65H 2601/11; B65H 2601/255
See application file for complete search history.

(56) References Cited

U.S. PATENT DOCUMENTS 5,966,302 A * 10/1999 Chrosny ..... B65H 7/06 700/127
2013/0168923 A1* 7/2013 Sugimoto ..... B65H 7/06 271/258.01
(Continued)

FOREIGN PATENT DOCUMENTS

JP 7-215510 A 8/1995
JP 2003-128318 A 5/2003
(Continued)

*Primary Examiner* — David H Bollinger
(74) *Attorney, Agent, or Firm* — Canon U.S.A., Inc. IP Division

(57) ABSTRACT

A feeding apparatus includes a feeding rotary member, a conveying rotary member pair, an output unit, a detection unit, and a control unit. The conveying rotary member pair includes first and second rotary members. The control unit stops a feeding operation when the detection unit does not detect the recording material by the time when a threshold time has elapsed after an operation of feeding a recording material is stated. The control unit determines that the recording material is stopped at a position on an upstream side relative to the nip portion in the feeding direction in a case where a rotation speed of the second rotary member, indicated by a state signal output from the output unit at least in a period of time from when the recording material reaches the nip portion to when the feeding operation is stopped, is faster than a threshold speed.

20 Claims, 16 Drawing Sheets

(51) Int. Cl.

| | |
|---|---|
| ***B65H 5/06*** | (2006.01) |
| ***B65H 7/14*** | (2006.01) |
| ***B65H 3/52*** | (2006.01) |
| *G03G 21/16* | (2006.01) |

(52) U.S. Cl.
CPC ..... *G03G 21/1633* (2013.01); *G03G 2215/00548* (2013.01); *G03G 2221/1675* (2013.01)

(56) References Cited

U.S. PATENT DOCUMENTS

| | | | | |
|---|---|---|---|---|
| 2013/0221602 | A1* | 8/2013 | Walsh | B65H 3/0669 271/10.11 |
| 2014/0153993 | A1* | 6/2014 | Ono | B41J 11/42 400/621 |
| 2014/0361482 | A1* | 12/2014 | Iizuka | B65H 7/08 271/111 |
| 2015/0239695 | A1* | 8/2015 | Noda | B65H 7/14 271/265.01 |

FOREIGN PATENT DOCUMENTS

| | | | |
|---|---|---|---|
| JP | 2004-280076 | A | 10/2004 |
| JP | 2006-193286 | A | 7/2006 |
| JP | 2008-120502 | A | 5/2008 |

* cited by examiner

FEEDING APPARATUS

BACKGROUND OF THE INVENTION

Field of the Invention

The present disclosure relates to a technique of providing information for removal of a recording material which is stuck inside an image forming apparatus, such as a copier or a printer, and a feeding apparatus employed in the image forming apparatus.

Description of the Related Art

In general, in an image forming apparatus, such as a copier or a printer, a recording material may be stuck in the apparatus during a feeding operation. If such feeding failure (hereinafter referred to as sheet jam) occurs, a recording material which causes the sheet jam (hereinafter referred to as a jam sheet) is to be removed from the inside of the apparatus.

Japanese Patent Laid-Open No. 2004-280076 discloses an image forming apparatus including a feeding roller which feeds a recording material from a cassette to a conveying path and a sensor which detects the recording material and which is disposed on the conveying path. If the sensor does not detect a recording material for a predetermined period of time after an operation of feeding a recording material is started using the feeding roller, it is determined that delay jam has occurred. The image forming apparatus according to Japanese Patent Laid-Open No. 2004-280076 has a door which opens the conveying path. When opening the door, a user may remove a jam sheet which is stuck inside the apparatus.

In Japanese Patent Laid-Open No. 2004-280076, a determination as to whether the jam sheet is stopped in a state in which the jam sheet extends across the cassette and the conveying path or a state in which a jam sheet is accommodated in the cassette is not made when the delay jam occurs. Accordingly, when the jam sheet is stopped in the state in which the jam sheet is accommodated in the cassette, the user may not visually recognize the jam sheet only by opening the door, and therefore, the cassette is required to be opened and this is burdensome for the user.

SUMMARY OF THE INVENTION

The present disclosure provides a feeding apparatus that reduces burden of a user while clearing a jam.

A feeding apparatus according to the present disclosure includes a feeding rotary member configured to feed a recording material accommodated in an accommodation unit and a conveying rotary member pair configured to convey the recording material fed by the feeding rotary member. The conveying rotary member pair includes first and second rotary members which form a nip portion and the recording material is conveyed while being nipped in the nip portion. The feeding apparatus further includes an output unit configured to output a state signal in accordance with a rotation state of the second rotary member, a detection unit configured to determine whether the recording material has reached a position on a downstream side relative to the nip portion in a feeding direction of the recording material, and a control unit configured to stop the feeding operation in a case where the detection unit does not detect the recording material by the time when a threshold time has elapsed after the feeding operation is started on the recording material by the feeding rotary member and the conveying rotary member pair. The control unit determines that the recording material is stopped at a position on an upstream side relative to the nip portion in the feeding direction in a case where a rotation speed of the second rotary member, indicated by the state signal output from the output unit at least in a period of time from when a period of time required for the recording material to reach the nip portion has elapsed to when the feeding operation is stopped, is faster than a threshold speed.

Further features of the present disclosure will become apparent from the following description of exemplary embodiments with reference to the attached drawings.

DESCRIPTION OF THE EMBODIMENTS

First Embodiment

Configuration of Image Forming Apparatus

Figure 1:
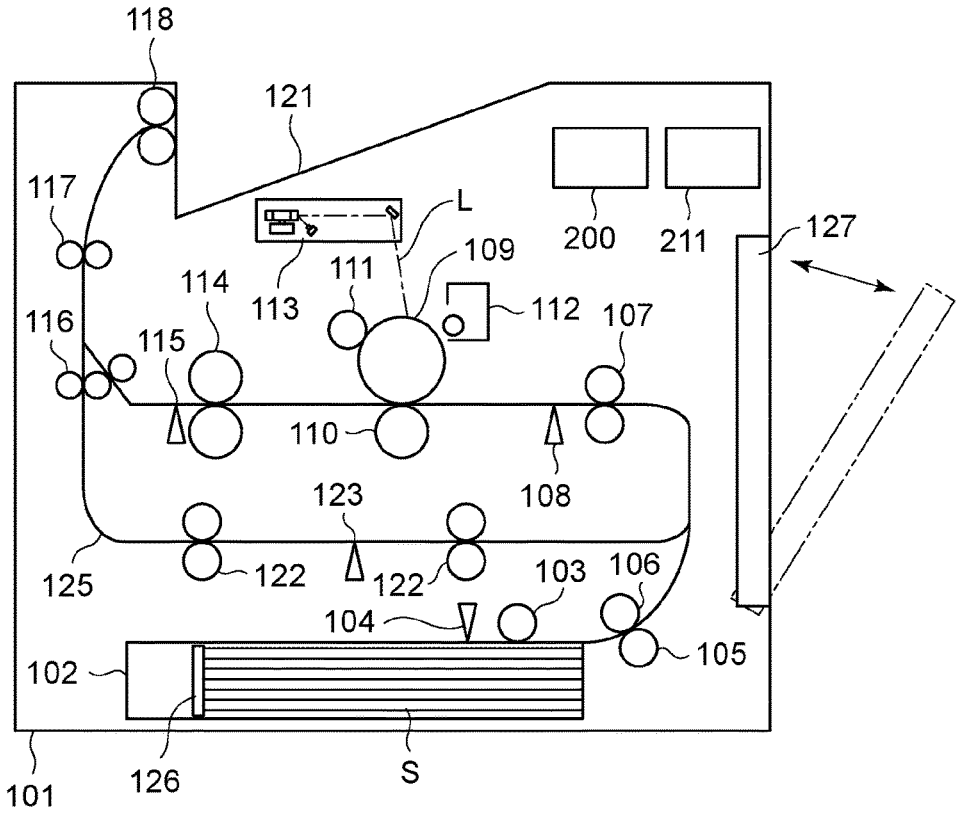
FIG. 1 is a diagram schematically illustrating a configuration of an image forming apparatus.

In a first embodiment, a laser beam printer 101 (hereinafter referred to as a printer 101) employing an electrophotographic printing method will be described as an image forming apparatus. FIG. 1 is a diagram schematically illustrating a configuration of the printer 101.

A cassette 102 is an accommodation unit which accommodates sheets S (recording materials) and is detachable from a body of the printer 101. A rear-end regulating plate 126 disposed in the cassette 102 regulates rear ends (ends on an upstream side in a feeding direction) of the sheets S accommodated in the cassette 102. The rear-end regulating plate 126 is movable in the feeding direction and is disposed in a regular position corresponding to a size (a length in the feeding direction) of the sheets S so that the sheets S are set in an appropriate position.

A pickup roller 103 (a feeding rotary member, and hereinafter referred to as a pick-roller 103) feeds (conveys) the sheets S accommodated in the cassette 102 in a state in which the cassette 102 is attached to the body of the printer 101. Each of the sheets S which is fed by the pick-roller 103 is supplied to a downstream side by a feed roller 106 (a conveying rotary member) and reaches a top sensor 108 through a pair of registration rollers 107 (hereinafter referred to as a registration-roller pair 107). A separation roller 105 (a separation rotary member) forms a separation nip portion with the feed roller 106 so as to prevent a plurality (two or more) of the sheets S are supplied to the downstream side relative to the separation nip portion. Operation of the separation roller 105 will be described in detail hereinafter. By this, only one of the sheets S accommodated in the cassette 102 which is positioned in an uppermost portion in a vertical direction is fed to the registration-roller pair 107. The conveying rotary member and the separation rotary member are collectively referred to as a conveying rotary member pair.

The sheet S detected by the top sensor 108 (a detection unit) is in turn conveyed to an image forming unit. The image forming unit includes a photosensitive drum 109, a charge roller 111, a laser scanner 113, a developing device 112, a transfer roller 110, and a fixing device 114. The photosensitive drum 109 is uniformly charged by the charge roller 111 and is irradiated with laser light L by the laser scanner 113 so that an electrostatic latent image is formed on a surface of the photosensitive drum 109. The electrostatic latent image formed as described above is visualized as a tonner image when toner is supplied from the developing device 112. The photosensitive drum 109 and the transfer roller 110 form a transfer nip portion, and the sheet S is conveyed to the transfer nip portion in synchronization with rotation of the photosensitive drum 109. The toner image formed on the photosensitive drum 109 is transferred on the sheet S in the transfer nip portion. A voltage having polarity which is opposite to that of the toner image is applied to the transfer roller 110 so that the toner image is transferred. The sheet S on which the toner image has been transferred is conveyed to the fixing device 114 which heats and presses the sheet S. As a result, the toner image transferred to the sheet S is fixed on the sheet S. The sheet S to which the toner image is fixed is conveyed by triple rollers 116, intermediate discharge rollers 117, and discharge rollers 118 and is discharged to a discharge tray 121. The series of printing operations is thus terminated.

Furthermore, in a case where double-sided printing is performed on the sheet S, the sheet S is not discharged to the discharge tray 121 after single-side printing is performed on the sheet S, and the triple rollers 116, the intermediate discharge rollers 117, and the discharge rollers 118 are reversely rotated after a rear end of the sheet S has passed the triple rollers 116. The sheet S is conveyed to a double-sided conveying path 125 and further conveyed by double-sided conveying rollers 122 to the image forming unit again. In this way, the double-sided printing is performed on the sheet S.

Furthermore, in FIG. 1, a fixing discharge sensor 115 and a double-sided conveying sensor 123 are disposed so as to determine whether the sheet S is appropriately conveyed. Furthermore, a sheet detection sensor 104 determines whether a sheet S is accommodated in the cassette 102. The printer 101 includes an operation panel 211 (hereinafter referred to as a panel 211), serving as a display unit, which displays various information for a user. The printer 101 further includes a door 127 which is openable relative to the apparatus body. The user may access the conveying path on the downstream side in the sheet feeding direction relative to the separation nip portion by opening the door 127.

Figure 2A:
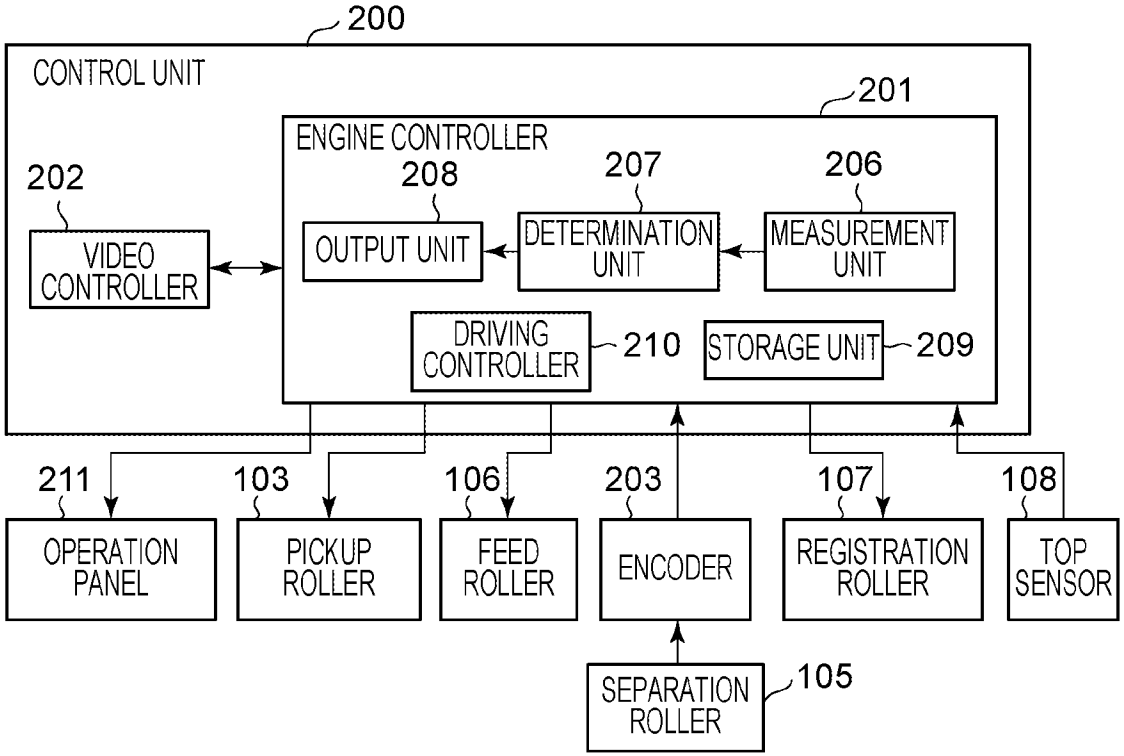
FIGS. 2A and 2B are block diagrams illustrating control performed by the image forming apparatus.

FIG. 2A is a block diagram illustrating a control unit 200 of the printer 101. The control unit 200 includes an engine controller 201 and a video controller 202 which communicate with each other so as to realize the printing operation described above. When a print instruction is issued from an external apparatus (such as a personal computer (a PC)) not illustrated, the video controller 202 analyzes image data and the engine controller 201 controls mechanisms of the printer 101 in accordance with a result of the analysis.

An encoder 203 (an output unit) which detects a rotation speed (the number of rotations per unit time) of the separation roller 105 is connected to the engine controller 201. As the encoder 203, a code wheel which is coaxially disposed with the separation roller 105 and which rotates with the separation roller 105 may be used. The printer 101 includes a photosensor including a light emission unit and a light reception unit and outputs a pulse signal by reading a plurality of slits formed on the code wheel. The photosensor outputs an ON signal when the light reception unit receives light which is emitted from the light emission unit and which passes the slits and outputs an OFF signal when the light reception unit does not receive any light so as to output a pulse signal. The engine controller 201 may detect the rotation speed of the separation roller 105 in accordance with an output interval (period) of the pulse signal. Furthermore, a magnetic rotary encoder, a photo-interrupter, or the like, may be employed depending on required accuracy or a disposed position.

The engine controller 201 includes a measurement unit 206, a determination unit 207, an output unit 208, a storage unit 209, and a driving controller 210. The measurement unit 206 measures a period of time from when the pick-roller 103 starts feeding of the sheet S to when the top sensor 108 detects the sheet S. Furthermore, the measurement unit 206 measures a rotation speed of the separation roller 105 using the encoder 203. The determination unit 207 determines whether sheet feeding failure (jam) of the sheet S has occurred based on the period of time measured by the measurement unit 206. When the sheet feeding failure has occurred, the determination unit 207 determines a position of the sheet S which is stuck inside the apparatus body based on the rotation speed of the separation roller 105 measured by the measurement unit 206. Then the determination unit 207 selects one of the cassette 102 and the door 127 as an access position for removing the stuck sheet S to an outside of the apparatus body. The output unit 208 outputs information (an image or a message) indicating the access position selected by the determination unit 207 to the panel 211. The storage unit 209 stores information on a request of printing transmitted from the video controller 202 and the rotation speed of the separation roller 105 measured by the measurement unit 206. The driving controller 210 performs switching of driving states of the pick-roller 103, the feed roller 106, the separation roller 105, and the registration-roller pair 107 in accordance with results of detections of the sensors so as to control activation and stop of a sheet feeding mechanism.

Figure 2B:
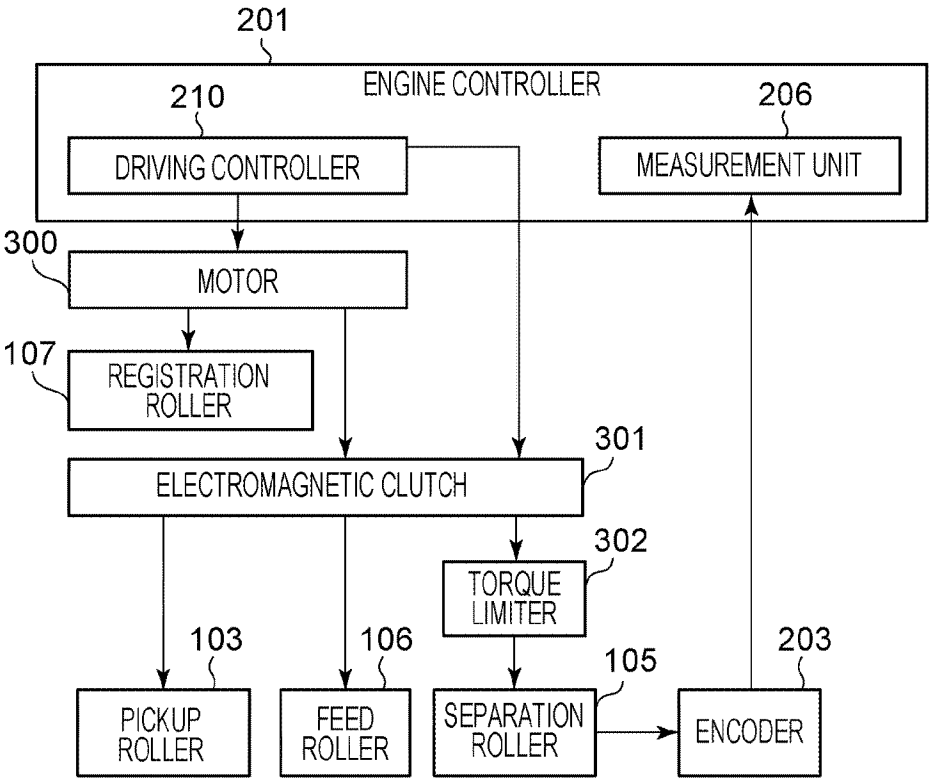

FIG. 2B is a block diagram illustrating the sheet feeding mechanism in detail. In FIG. 2B, a motor 300 is a driving source which drives the pick-roller 103, the feed roller 106, the separation roller 105, and the registration-roller pair 107. An electromagnetic clutch 301 transmits driving force of the motor 300 to the pick-roller 103, the feed roller 106, and the separation roller 105 or blocks the driving force to be transmitted to the pick-roller 103, the feed roller 106, and the separation roller 105. The driving controller 210 controls the motor 300 and the electromagnetic clutch 301 so as to perform switching between ON and OFF of the driving force to be transmitted to the various members. Although described in detail hereinafter, the driving controller 210 transmits the driving force to the pick-roller 103, the feed roller 106, and the registration-roller pair 107 in a direction in which the sheet S is fed whereas the driving controller 210 transmits the driving force to the separation roller 105 in a direction in which the feeding of the sheet S is prevented. Furthermore, a torque limiter 302 is disposed between the electromagnetic clutch 301 and the separation roller 105. The encoder 203 is disposed on the printer 101 so as to detect a rotation state of the separation roller 105, and information detected by the encoder 203 is supplied to the measurement unit 206. Note that, although a so-called retard roller which receives the driving force in the direction in which feeding of the sheet S is prevented is described as the separation roller 105, for example, in this embodiment, a roller which does not receives the driving force may be employed.

Feeding Operation

Next, sheet feeding control performed by the printer 101 of this embodiment will be described with reference to FIGS. 3A to 3E and FIG. 4. FIGS. 3A to 3E are cross-sectional views illustrating a sheet feeding mechanism at various timings when an operation of feeding a sheet from the cassette 102 (a feeding operation) is performed. In FIGS. 3A to 3E, black arrows indicate states in which corresponding rollers rotate by the driving force supplied from the motor 300 and white arrows indicate states in which corresponding rollers are driven to be rotated in accordance with the sheet S which is in contact with the rollers or counterpart rollers. In graphs in FIG. 4, axes of abscissae denote an elapsed time and axes of ordinates individually denote an ON/OFF state of the pick-roller 103, a signal waveform of the top sensor 108, and a rotation speed V of the separation roller 105. Timings Ta to Te in the graphs of FIG. 4 correspond to the states illustrated in FIGS. 3A to 3E, respectively.

Figure 3A:
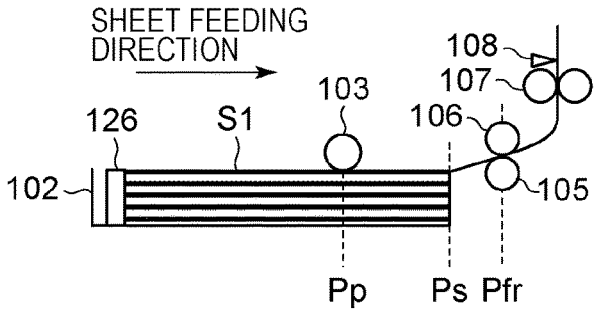
FIGS. 3A to 3E are cross-sectional views illustrating a feeding operation.

FIG. 3A is a cross-sectional view of the cassette 102 at a timing when feeding of a sheet S1 positioned on an uppermost portion in the cassette 102 is started. The timing Ta in the graphs of FIG. 4 corresponds to the state illustrated in FIG. 3A. When the sheet feeding operation is started, the pick-roller 103, the feed roller 106, and the separation roller 105 individually rotate and the sheet S1 is fed to the right (a sheet feeding direction) in FIG. 3A. Here, the start of the sheet feeding operation indicates that the driving controller 210 rotates the motor 300, turns on the electromagnetic clutch 301, and transmits the driving force of the motor 300 to the pick-roller 103, the feed roller 106, and the separation roller 105. The registration-roller pair 107 rotates when the driving controller 210 rotates the motor 300. In FIG. 3A, "Ps" indicates a leading end position of the sheets S positioned by the rear-end regulating plate 126. Here, the leading end of the sheets S indicates an end on a downstream side in the sheet feeding direction of the sheets S. "Pp" indicates a position where the pick-roller 103 nips each of the sheets S. "Pfr" indicates a position of the separation nip portion formed by the feed roller 106 and the separation roller 105.

The driving force is transmitted to the separation roller 105 in the direction in which feeding of the sheets S is prevented (a counterclockwise direction in FIG. 3A), and the torque limiter 302 is provided. When the feed roll 106 starts rotation in the direction in which the sheets S are fed (the counterclockwise direction in FIG. 3A), the separation roller 105 is operated by the torque limiter 302 as below. First, when a sheet S is not positioned in the separation nip portion, force received by the separation roller 105 due to friction between the separation roller 105 and the feed roller 106 is larger than a rotation load of the torque limiter 302. Therefore, the separation roller 105 is rotated by the feed roller 106 in the direction in which the sheets S is fed (a clockwise direction in FIG. 3A). When one of the sheets S is conveyed to the separation nip portion, force received by the separation roller 105 due to the friction between the separation roller 105 and the sheet S is larger than the rotation load of the torque limiter 302. Therefore, the separation roller 105 is rotated in the direction in which the sheet S is fed. On the other hand, when two or more sheets S are conveyed to the separation nip portion in an overlapping manner, the rotation load of the torque limiter 302 is larger than a conveying force of the sheets S. Therefore, the separation roller 105 stops the rotation thereof since the conveying force and the rotation load cancel each other or starts rotation in the direction in which the sheet feeding is prevented since the rotation load of the torque limiter 302 is larger.

Figure 3B:
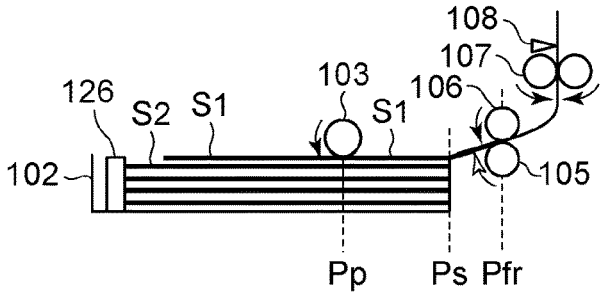

FIG. 3B is a cross-sectional view of the cassette 102 at a timing when a leading end of the sheet S1 reaches a position Pfr of the separation nip portion formed by the feed roller 106 and the separation roller 105. The timing Tb in the graphs of FIG. 4 corresponds to the state illustrated in FIG. 3B. After the leading end of the sheet S1 reaches the position Pfr of the separation nip portion formed by the feed roller 106 and the separation roller 105 at the timing Tb, the separation roller 105 is driven to be rotated in accordance with the sheet S1.

Figure 3C:
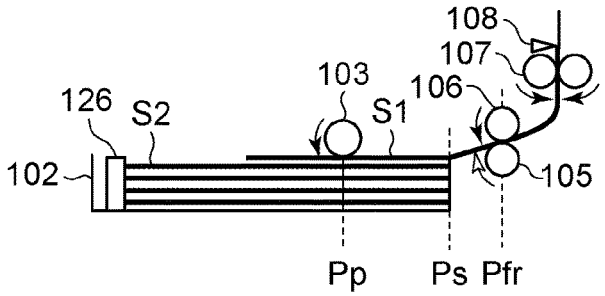

FIG. 3C is a cross-sectional view of the cassette 102 at a timing when the leading end of the sheet S1 reaches the registration-roller pair 107 and the top sensor 108. The timing Tc in the graphs of FIG. 4 corresponds to the state illustrated in FIG. 3C. After the leading end of the sheet S1 is in contact with the registration-roller pair 107 at the timing Tc, the registration-roller pair 107 conveys the sheet S1.

Figure 3D:
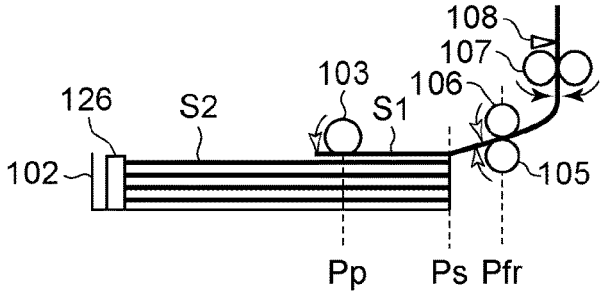

FIG. 3D is a cross-sectional view of the cassette 102 at a timing when a time Toff has elapsed after the leading end of the sheet S1 reaches the top sensor 108. The time Toff is set to be shorter than a period of time from when the leading end of the sheet S1 reaches the top sensor 108 to when a trailing end of the sheet S1 reaches the position Pp in a nip portion. A timing Td in the graphs of FIG. 4 corresponds to the state illustrated in FIG. 3D. The driving controller 210 changes an ON state of the electromagnetic clutch 301 into an OFF state at the timing Td. In this way, in the printer 101, the driving state of the pick-roller 103 is changed from an ON state to an OFF state before the trailing end of the sheet S1 reaches the position Pp of the nip portion of the pick-roller 103 so that a state in which a sheet S2 inserted into the separation nip portion causes jam is avoided. Although the driving of the pick-roller 103 is turned off, the sheet S1 is conveyed by the registration-roller pair 107, and therefore, the pick-roller 103 is driven to be rotated in accordance with the sheet S1. Furthermore, although the feed roller 106 and the separation roller 105 are also turned off, the sheet S1 is conveyed by the registration-roller pair 107, and therefore, the feed roller 106 and the separation roller 105 are also driven to be rotated in accordance with the sheet S1.

Figure 3E:
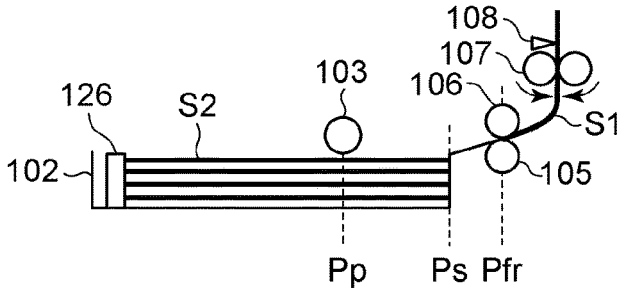

FIG. 3E is a cross-sectional view of the cassette 102 at a timing when the leading end of the sheet S1 has passed the position Pfr of the separation nip portion formed by the feed roller 106 and the separation roller 105. The timing Te in the graphs of FIG. 4 corresponds to the state illustrated in FIG. 3E. The rotation of the pick-roller 103 is stopped since the trailing end of the sheet S1 has passed the position Pp of the nip portion of the pick-roller 103. Furthermore, the rotation of the feed roller 106 and the separation roller 105 is stopped since the trailing end of the sheet S1 has passed the position Pfr of the separation nip portion. The sheet S1 is conveyed by the registration-roller pair 107 on a downstream side of the sheet feeding direction.

Designation of Sheet Position in Feeding Failure

Next, a case where sheet feeding failure occurs before one of the sheets S reaches the top sensor 108 will be described with reference to FIGS. 5A and 5B and FIGS. 6A and 6B.

Figure 5A:
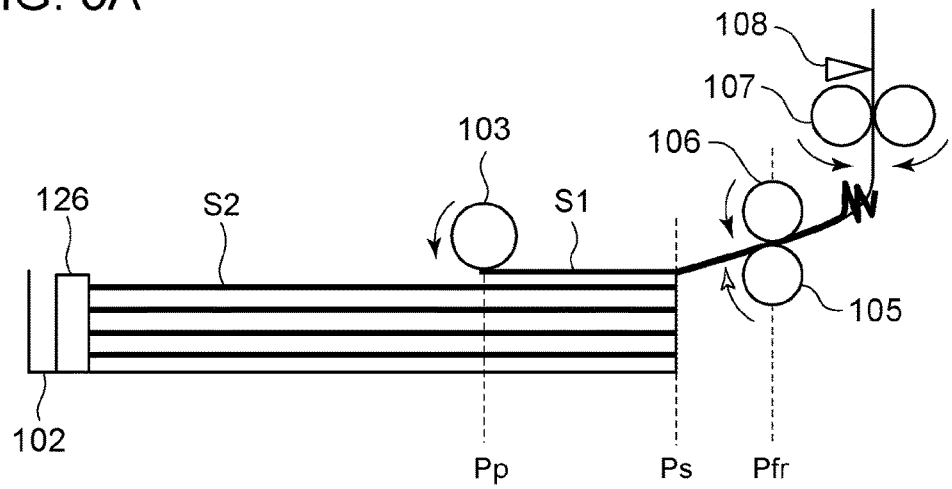
FIGS. 5A and 5B are cross-sectional views illustrating a case where feeding failure occurs.

FIG. 5A is a diagram illustrating a state in which sheet jam has occurred when the sheet feeding operation illustrated in FIGS. 3A to 3E is executed such that the leading end of the sheet S1 is stopped in a position on the downstream side in the sheet feeding direction relative to the separation nip portion and on an upstream side in the sheet feeding direction relative to the top sensor 108. In this case, the user preferably performs jam clearance by opening the door 127. A reason thereof will now be described.

If the cassette 102 is opened in the state of FIG. 5A, in a side-oriented configuration, that is, in a configuration in which the sheet feeding direction is orthogonal to a mounting and detaching direction of the cassette 102, the sheet S1 which stops across the separation nip portion is deformed or torn, and therefore, the jam clearance may be difficult. Furthermore, also in a front-oriented configuration, that is, in a configuration in which the sheet feeding direction is parallel to the mounting and detaching direction of the cassette 102, the jam clearance may be difficult. For example, when the sheet S1 is extracted from the trailing end after the cassette 102 is opened, an excessive load is applied to the sheet S1 in the separation nip portion, and therefore, the sheet S1 may be deformed or torn. The excessive load is applied to the sheet S1 in the separation nip portion since the sheet S1 is extracted in a direction opposite to the sheet feeding direction. Accordingly, if the sheet S1 is extracted from the leading end after the door 127 is opened, the excessive load is not applied to the sheet S1 and the user may easily perform the jam clearance.

Figure 4:
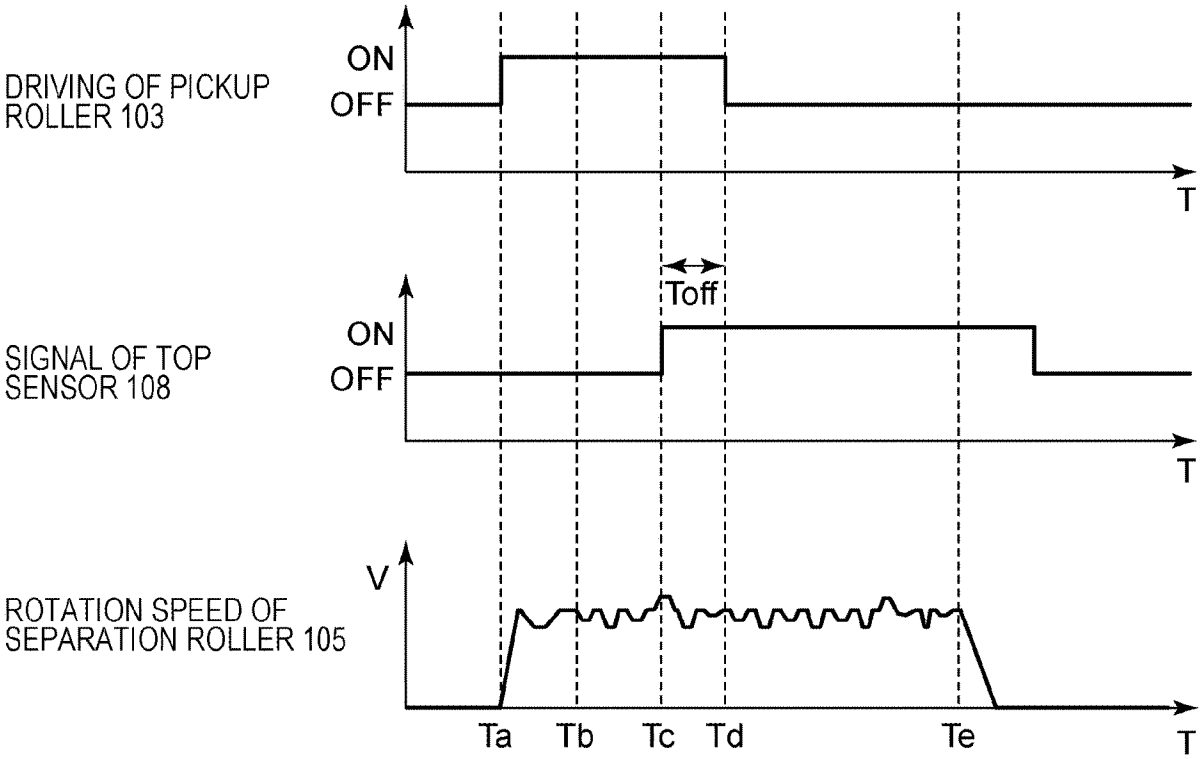
FIG. 4 is a timing chart illustrating the feeding operation.
Figure 6A:
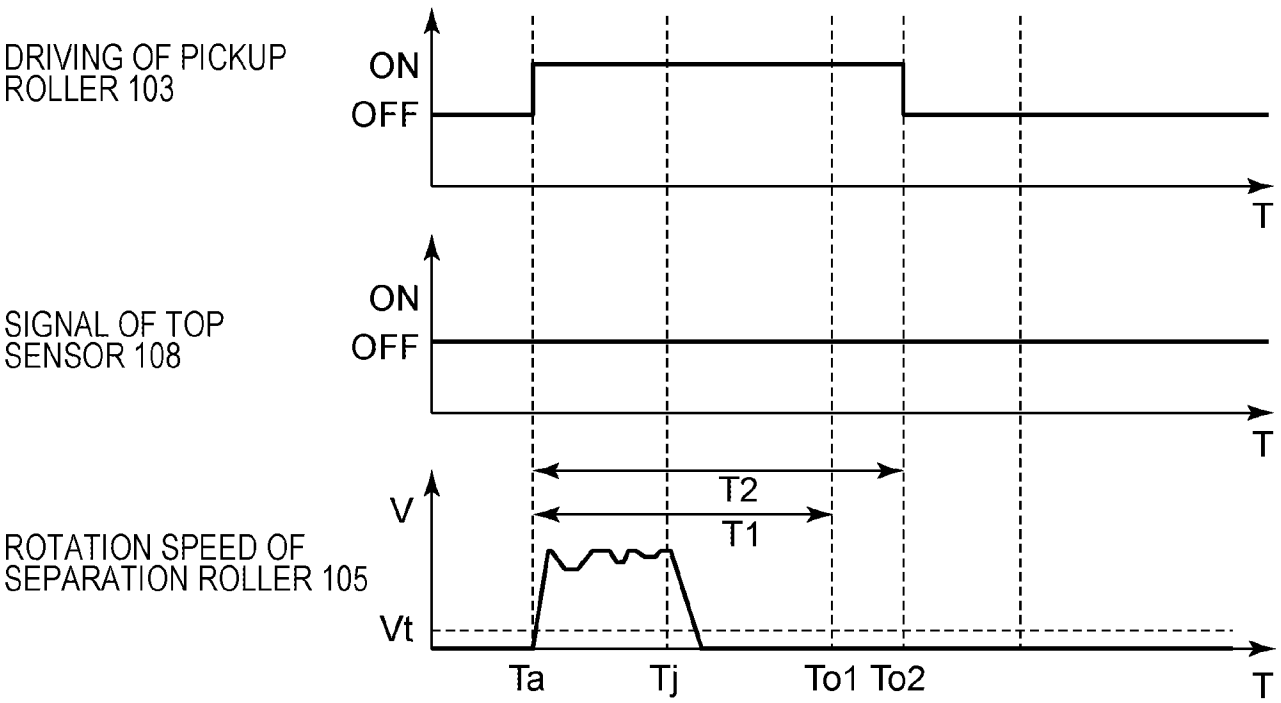
FIGS. 6A and 6B are timing charts illustrating a case where feeding failure occurs according to a first embodiment.

A graph in FIG. 6A illustrates an ON/OFF state of driving of the pick-roller 103, a signal waveform of the top sensor 108, and a rotation speed V of the separation roller 105 when the sheet jam occurs as illustrated in FIG. 5A. As illustrated in FIG. 4, at the timing Ta, the driving states of the pick-roller 103, the feed roller 106, and the separation roller 105 are switched from an OFF state to an ON state and the separation roller 105 is driven to be rotated in accordance with the feed roller 106. A timing Tj in the graph of FIG. 6A corresponds to the state in FIG. 5A. Specifically, the jam occurs at the timing Tj. Conveying resistance of the sheet S1 is increased due to the sheet jam and a conveying speed of the sheet S1 is lowered. When the conveying resistance of the sheet S1 becomes larger than conveying force of the pick-roller 103 to the sheet S1, conveyance of the sheet S1 stops over time. Consequently, the rotation speed of the separation roller 105 which is driven to be rotated in accordance with the sheet S1 is also reduced similarly to a conveyance speed of the sheet S1 and the separation roller 105 stops over time.

At a timing To1 in the graph of FIG. 6A, a threshold time T1 has elapsed after the pick-roller 103 starts feeding the sheet S1. The threshold time T1 is longer than a period of time until the leading end of the sheet S1 has reached the position Pfr of the separation nip portion when the sheet S1 is appropriately conveyed and shorter than a threshold time T2 described below. Specifically, at the timing To1, the sheet S1 is conveyed in the separation nip portion when the sheet S1 is appropriately conveyed. At a timing To2, the threshold time T2 has elapsed after the pick-roller 103 starts feeding the sheet S1. The threshold time T2 is used when the determination unit 207 determine occurrence of the sheet feeding failure. Specifically, if the top sensor 108 has not detected the sheet S1 at the timing To2, the determination unit 207 determines that the sheet feeding failure has occurred. When the determination unit 207 determines that the sheet feeding failure has occurred, the driving controller 210 switches the driving states of the pick-roller 103, the feed roller 106, and the separation roller 105 to the OFF state. As illustrated in FIG. 6A, a rotation speed of the separation roller 105 in a period from the timing To1 to the timing To2 is lower than a rotation speed of the separation roller 105 in a period from the timing Ta to the timing Tb in FIG. 4 or is zero.

Figure 5B:
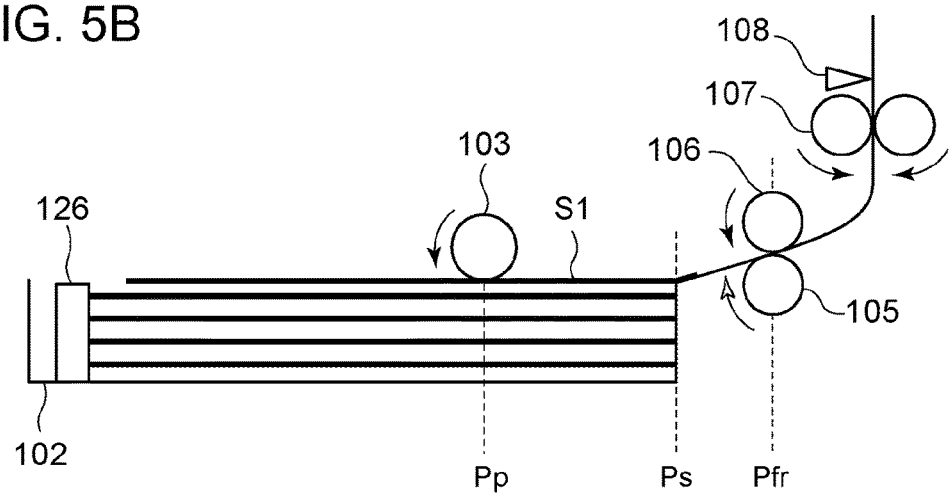

On the other hand, FIG. 5B is a diagram illustrating a state in which, when the sheet feeding operation illustrated in FIGS. 3A to 3E is executed, sheet jam occurs such that the leading end of the sheet S1 stops in a position on the upstream side in the sheet feeding direction relative to the separation nip portion. In this case, the user preferably performs jam clearance by opening the cassette 102. This is because, even if opening the door 127 in the state of FIG. 5B, the user may not visually recognize the jam sheet, and therefore, the user may not perform the jam clearance.

Figure 6B:
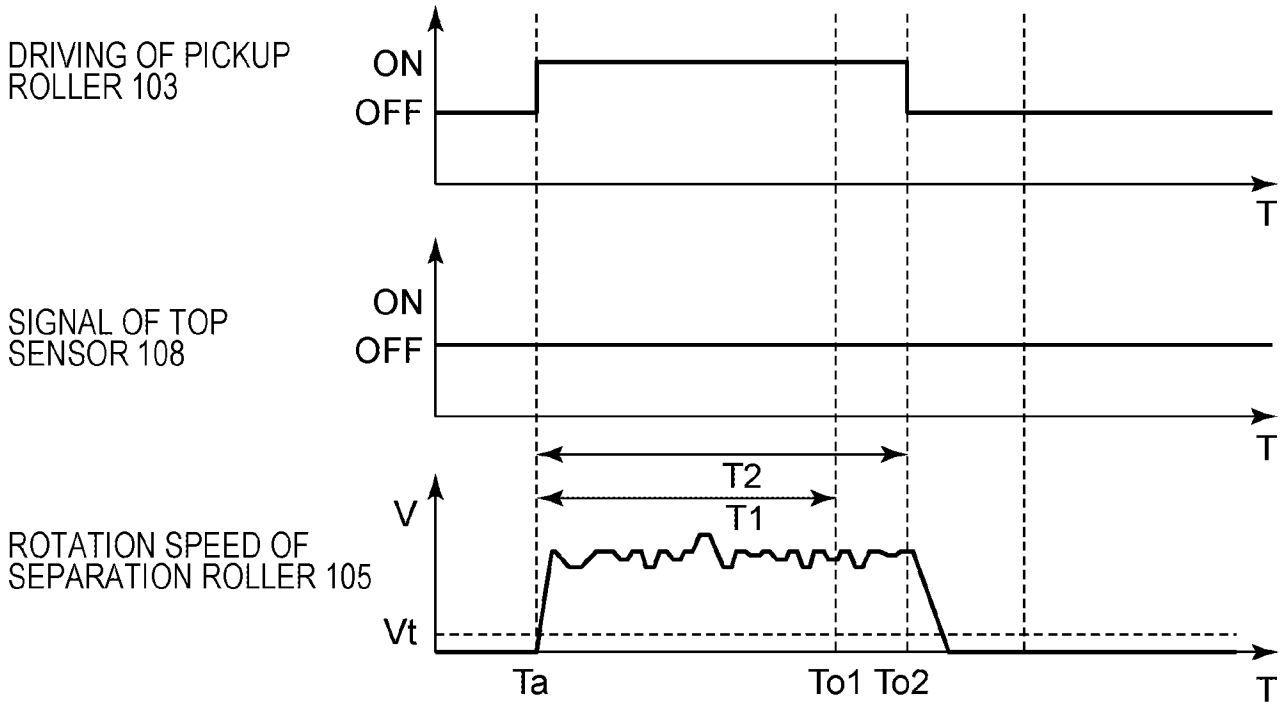

A graph in FIG. 6B illustrates an ON/OFF state of driving of the pick-roller 103, a signal waveform of the top sensor 108, and a rotation speed V of the separation roller 105 when sheet jam occurs as illustrated in FIG. 5B. As with the case of FIG. 6A, at the timing Ta, driving states of the pick-roller 103, the feed roller 106, and the separation roller 105 are switched from the OFF state to the ON state and the separation roller 105 is driven to be rotated. Here, if the sheet jam occurs as illustrated in FIG. 5B, the separation roller 105 is continuously driven to be rotated in accordance with the feed roller 106 since the sheet S1 does not exist in the separation nip portion. Specifically, the separation roller 105 is continuously driven to be rotated in accordance with the feed roller 106 until the determination unit 207 determines that the sheet feeding failure has occurred at the timing To2 and switches the driving states of the pick-roller 103, the feed roller 106, and the separation roller 105 to the OFF state. Accordingly, as illustrated in FIG. 6B, the rotation speed of the separation roller 105 in the period from the timing To1 to the timing To2 is substantially equal to the rotation speed of the separation roller 105 in the period from the timing Ta to the timing Tb in FIG. 4.

Accordingly, if the sheet feeding failure has occurred before the sheet S1 reaches the top sensor 108, a stop position of the sheet S1 which causes the sheet jam may be specified by the rotation speed of the separation roller 105 in the period from the timing To1 to the timing To2 (a detection period). Specifically, if the rotation speed of the separation roller 105 in the period from the timing To1 to the timing To2 is equal to or lower than a threshold speed Vt, the determination unit 207 may determine that the sheet jam illustrated in FIG. 5A has occurred. On the other hand, if the rotation speed of the separation roller 105 in the period from the timing To1 to the timing To2 is higher than the threshold speed Vt, the determination unit 207 may determine that the sheet jam illustrated in FIG. 5B has occurred.

If the stop position of the sheet S1 may be determined in this way, the determination unit 207 may select an access position for extracting the stuck sheet S1 out of the apparatus body. Then if the output unit 208 transmits a notification indicating the selected access position through the panel 211, usability may be improved.

However, even if the rotation speed of the separation roller 105 in the period from the timing To1 to the timing To2 is equal to or smaller than the threshold speed Vt, the sheet jam illustrated in FIG. 5A may not occur. This case will now be described in detail.

As described above, when two or more sheets are conveyed to the separation nip portion due to friction between the sheets, the separation roller 105 is stopped or starts rotation in the direction in which the sheet feeding is prevented. Therefore, in a case where the sheet S1 which is positioned on the uppermost portion may not be fed since the pick-roller 103 slips in the state in which the two or more sheets (sheets S2 and S3) are extracted to the separation nip portion due to the friction, a rotation speed of the separation roller 105 is equal to or lower than the threshold speed Vt. However, the sheet S1 stopped due to the sheet jam is accommodated in the cassette 102 and the sheet jam illustrated in FIG. 5B has occurred instead of the sheet jam illustrated in FIG. 5A. Furthermore, the sheet jam illustrated in FIG. 5B similarly occurs when the leading end of the fed sheet S1 is bent when the leading end encounters the feed roller 106 or the separation roller 105, and therefore, the sheet S1 may not be conveyed in the separation nip portion.

Therefore, in a case where a rotation speed of the separation roller 105 in the period from the timing To1 to the timing To2 is equal to or lower than the threshold speed Vt, it is difficult to uniquely specify a stop position of the sheet S1 which causes the sheet jam, and therefore, an access position is not selected in this embodiment.

Furthermore, when the sheet jam illustrated in FIG. 5A occurs, a conveying speed of the sheet S1 is reduced as described above. However, the trailing end of the sheet S1 may be continuously conveyed for a certain period of time while the leading end of the sheet S1 is bent in a jam occurrence position before the sheet S1 stops. Therefore, if the length of the sheet S1 is not efficiently long relative to a distance from the separation nip portion to the top sensor 108 on the conveying path, the trailing end of the sheet S1 may pass the separation nip portion before the sheet S1 stops after the sheet jam occurs.

If the trailing end of the sheet S1 passes the separation nip portion, the sheet S1 which causes the sheet lam is positioned on the downstream side in the sheet feeding direction relative to the separation nip portion and on the upstream side in the sheet feeding direction relative to the top sensor 108, and therefore, the sheet S1 is preferably extracted by opening the door 127. However, in this case, the trailing end of the sheet S1 has passed the separation nip portion, and therefore, the separation roller 105 is driven to be rotated in accordance with the feed roller 106 and the rotation speed thereof is not lowered. Therefore, depending on a timing when the trailing end of the sheet S1 passes the separation nip portion, the rotation speed of the separation roller 105 in the period from the timing To1 to the timing To2 becomes higher than the threshold speed Vt.

Consequently, although the output unit 208 transmits a notification which causes the user to extract the sheet S1 by opening the cassette 102 to the user, the notification corresponds to wrong detection since the sheet S1 which actually causes the sheet jam is positioned on the downstream side in the sheet feeding direction relative to the separation nip portion. Therefore, to prevent the wrong detection, if a length of the sheets S is shorter than a shortest length which is set in advance, selection of an access position is not performed in accordance with a rotation speed of the separation roller 105. Here, the shortest length is at least longer than the distance between the separation nip portion to the top sensor 108 on the conveying path. Specifically, the shortest length is obtained by adding a certain pushing margin length (10 mm, for example) to the distance between the separation nip portion and the top sensor 108 on the conveying path.

Furthermore, a friction coefficient on a sheet surface, a weight, and the like vary depending on a type (sheet type) of the sheets S, and therefore, increasing tendency of the conveyance resistance of the sheet S1 due to occurrence of sheet jam also varies depending on a type of the sheets S. Therefore, a period of time in which the trailing end of the sheet S1 is continuously conveyed for a certain period of time while the leading end of the sheet S1 is bent in the jam occurrence position varies depending on a sheet type. For example, in a case of a thin sheet, stiffness is weak, and therefore, the sheet S1 is continuously pushed until the sheet feeding operation is stopped at the timing To2. As a result, even in a case where the sheet jam illustrated in FIG. 5A occurs, the rotation speed of the separation roller 105 is higher than the threshold speed Vt. Therefore, to prevent the wrong detection, in the case of a thin sheet, the selection of an access position is not performed in accordance with the rotation speed of the separation roller 105, whereas in a case of a standard sheet which is thicker than the thin sheet, the selection of an access position is performed. Alternatively, in the case of the thin sheet, the shortest length described above may be changed to a longer value.

Flowchart of Access Position Determination

A method for determining an access position at the time of jam clearance according to this embodiment will be described with reference to flowcharts in FIGS. 7A and 7B. Control based on the flowcharts of FIGS. 7A and 7B is executed by a CPU installed in the engine controller 201 in accordance with programs stored in the storage unit 209, such as a read only memory (ROM).

Figure 7A:
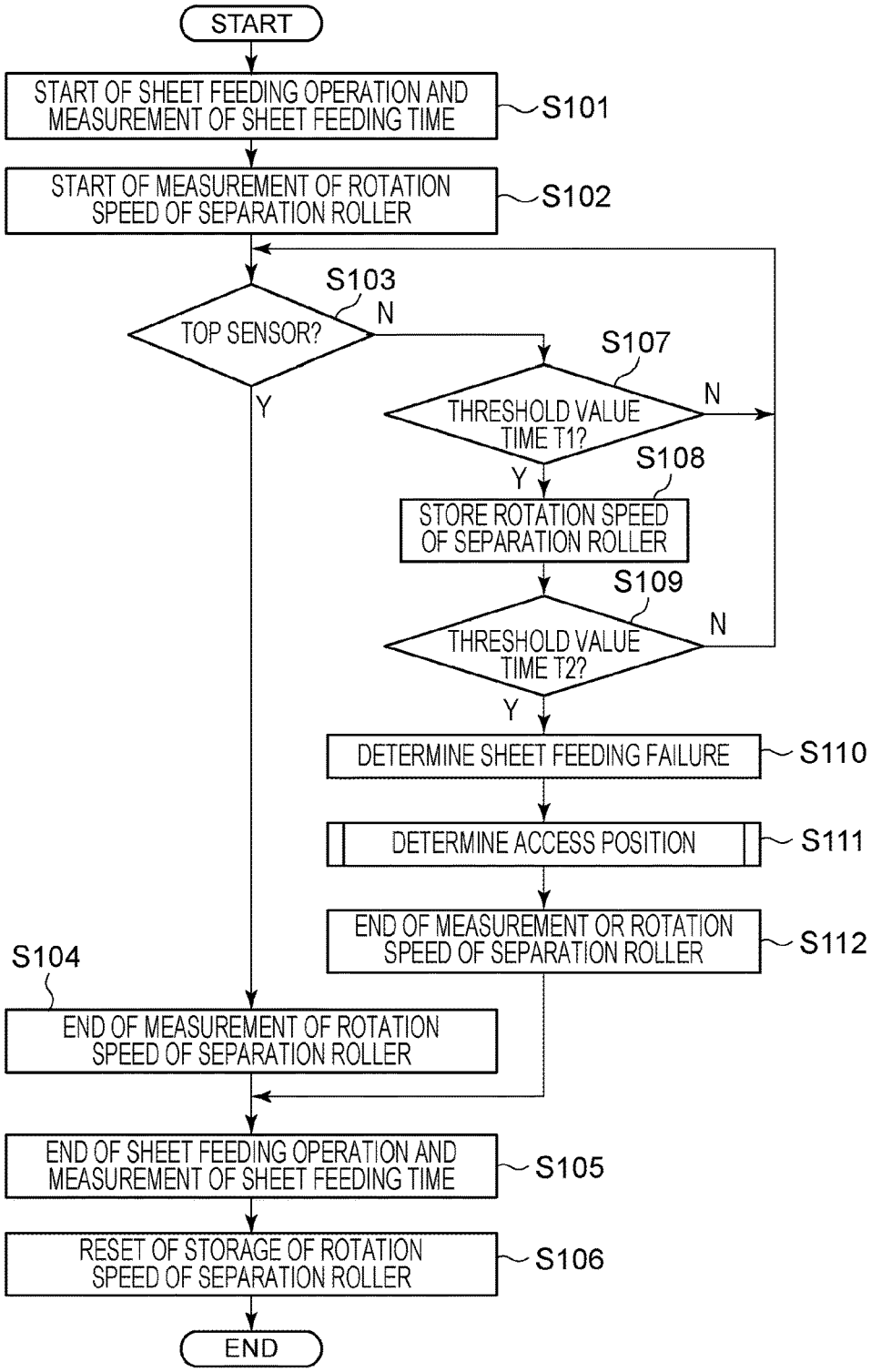
FIGS. 7A and 7B are flowcharts illustrating a determination of an access position according to the first embodiment.
Figure 7B:
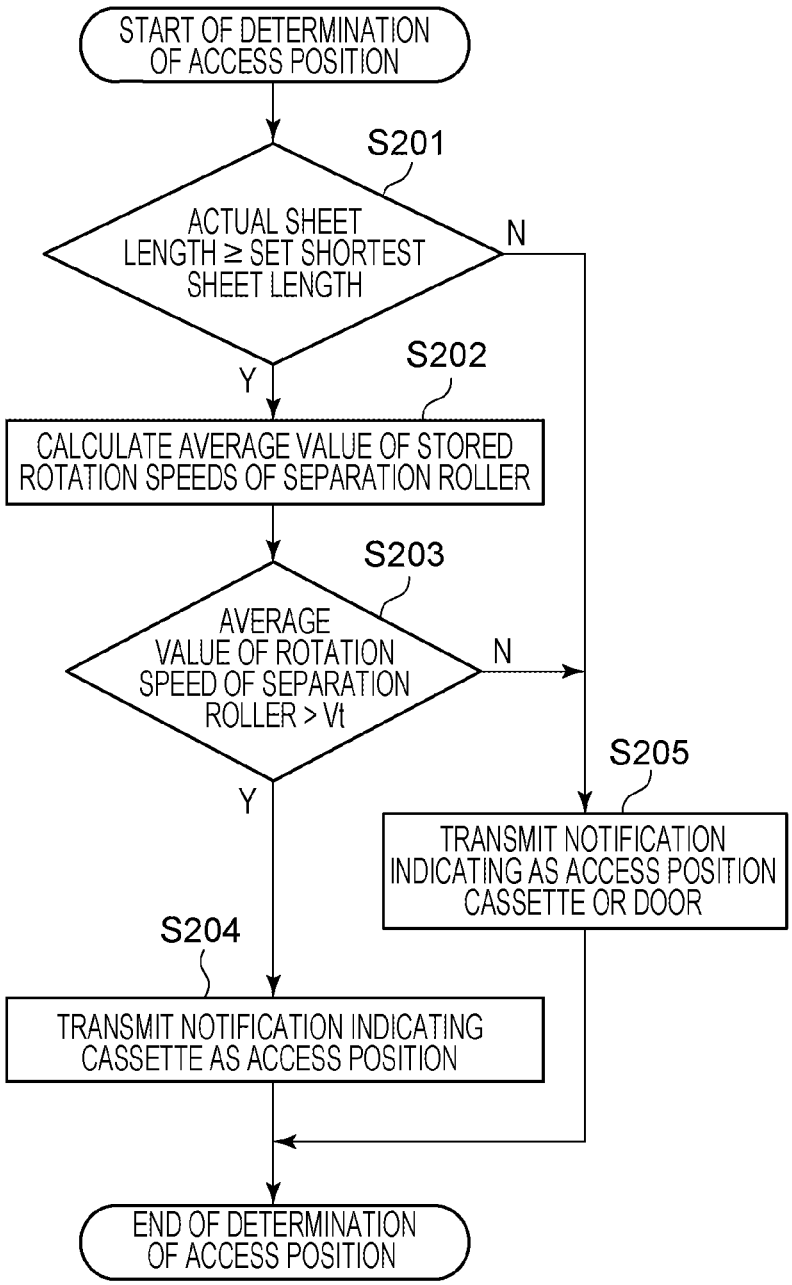

First, in FIG. 7A, the engine controller 201 transmits an instruction for starting sheet feeding to the driving controller 210 so as to start the sheet feeding operation. Simultaneously, the measurement unit 206 starts measurement of a sheet feeding time (S101). Thereafter, the measurement unit 206 starts measurement of a rotation speed of the separation roller 105 (S102). In step S103, the engine controller 201 determines whether the top sensor 108 has detected a sheet S. When the determination is affirmative, the measurement unit 206 terminates the measurement of the rotation speed of the separation roller 105 (S104). The engine controller 201 causes the driving controller 210 to terminate the sheet feeding operation and causes the measurement unit 206 to terminate the measurement of the sheet feeding time (S105). In step S106, the storage unit 209 resets stored rotation speed data of the separation roller 105.

On the other hand, when the determination is negative in step S103, the engine controller 201 determines whether the sheet feeding time measured by the measurement unit 206 exceeds the threshold time T1 (S107). When the determination is negative, the engine controller 201 causes the driving controller 210 to continuously perform the sheet feeding operation. When the determination is affirmative, the storage unit 209 stores the rotation speed of the separation roller 105 measured by the measurement unit 206 (S108). Thereafter, the engine controller 201 determines whether the sheet feeding time measured by the measurement unit 206 exceeds a threshold time T2 in step S109. When the determination is negative, the engine controller 201 causes the driving controller 210 to continuously perform the sheet feeding operation. When the determination is affirmative, the determination unit 207 determines that the sheet feeding failure has occurred (S110) and determines an access position for extracting the sheet S1 based on the rotation speed of the separation roller 105 stored in the storage unit 209 (S111). A subroutine in step S111 will be described below in detail. Thereafter, the measurement unit 206 terminates the measurement of the rotation speed of the separation roller 105 (S112).

The subroutine in step S111 will now be described with reference to FIG. 7B. First, the engine controller 201 obtains information on a length of the sheet S which is actually subjected to printing based on a print instruction issued by an external apparatus (such as a PC) not illustrated. Then the engine controller 201 determines whether the actual length of the sheet S is equal to or longer than a shortest length of the sheet S for determining an access position (S201). When the determination is affirmative, the engine controller 201 calculates an average value of rotation speeds of the separation roller 105 stored in the storage unit 209 (S202). When it is determined that the average value of the rotation speeds of the separation roller 105 is higher than the threshold speed Vt in step S203, the output unit 208 prompts, through the panel 211, the user to remove the jam sheet by accessing the cassette 102 (S204). When the average value of the rotation speed of the separation roller 105 is equal to or lower than the threshold speed Vt, the output unit 208 prompts, through the panel 211, the user to remove the jam sheet by accessing the door 127 (S205).

On the other hand, when it is determined that the actual length of the sheet S is shorter than the shortest length of the sheet S in step S201, the output unit 208 prompts, through the panel 211, the user to remove the jam sheet by accessing the cassette 102 or the door 127 (S205). The control for determination of an access position is thus terminated.

As described above, according to this embodiment, it is determined whether the cassette 102 is to be accessed by the user so that the jam sheet is removed based on the rotation speed of the separation roller 105. Accordingly, an image forming apparatus and a feeding apparatus which may reduce a burden of users when jam clearance is performed may be provided.

Second Embodiment

A second embodiment will now be described. Descriptions of main portions are the same as those of the first embodiment, and therefore, only portions different from the first embodiment will be described hereinafter.

Designation of Sheet Position in Sheet Feeding Failure

First, a method for specifying a sheet position at a time of sheet feeding failure according to this embodiment will be described. In the first embodiment, when the sheet feeding failure occurs before the sheet S1 reaches the top sensor 108, a position of the sheet S1 which stops and causes sheet jam is specified in accordance with a rotation speed of the separation roller 105 obtained in the period from the timing To1 to the timing To2. Here, in the printer 101, if a distance from the separation nip portion to the top sensor 108 on the conveying path is short or if a sheet feeding speed of the sheet S is set high, the threshold time T2 for determining the sheet feeding failure may be set to be short. In this case, the period from the timing To1 to the timing To2 for measuring rotation speed data of the separation roller 105 is short, and therefore, the printer 101 is sensitively affected by an outlier and an abnormal value, and accordingly, misjudgment may be made. In this embodiment, an appropriate determination is made even in this case.

Figure 8A:
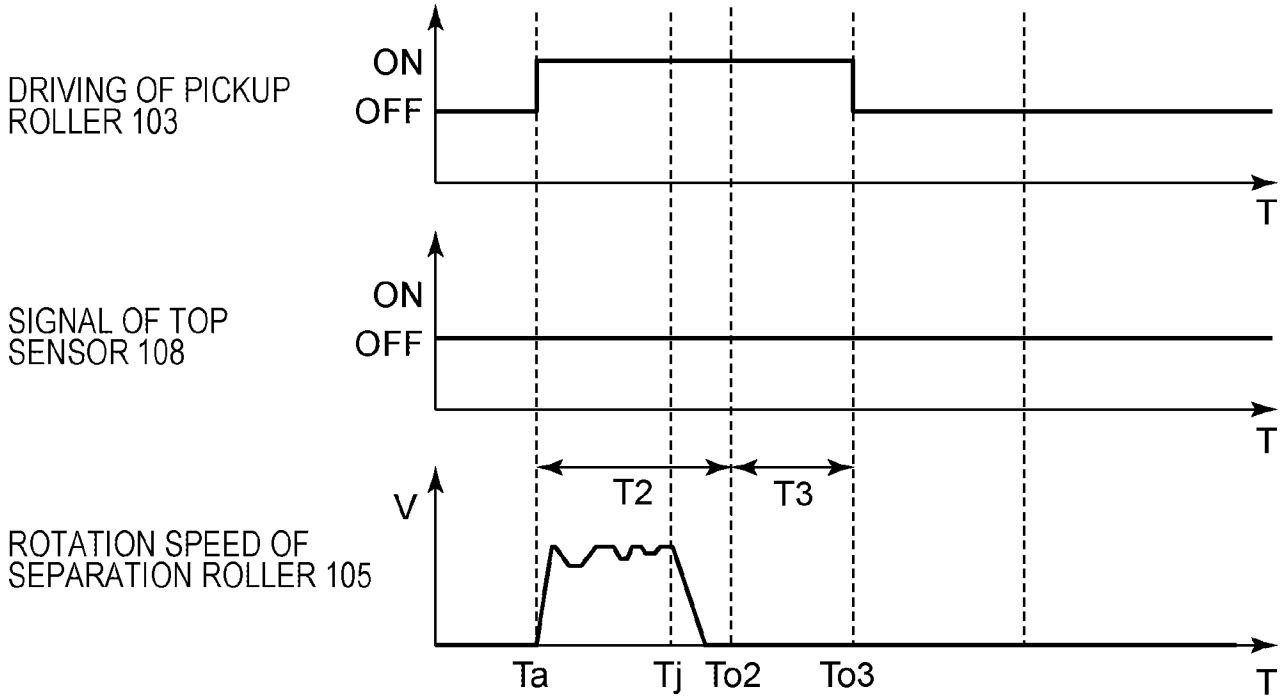
FIGS. 8A and 8B are timing charts illustrating a case where feeding failure occurs according to a second embodiment.
Figure 8B:
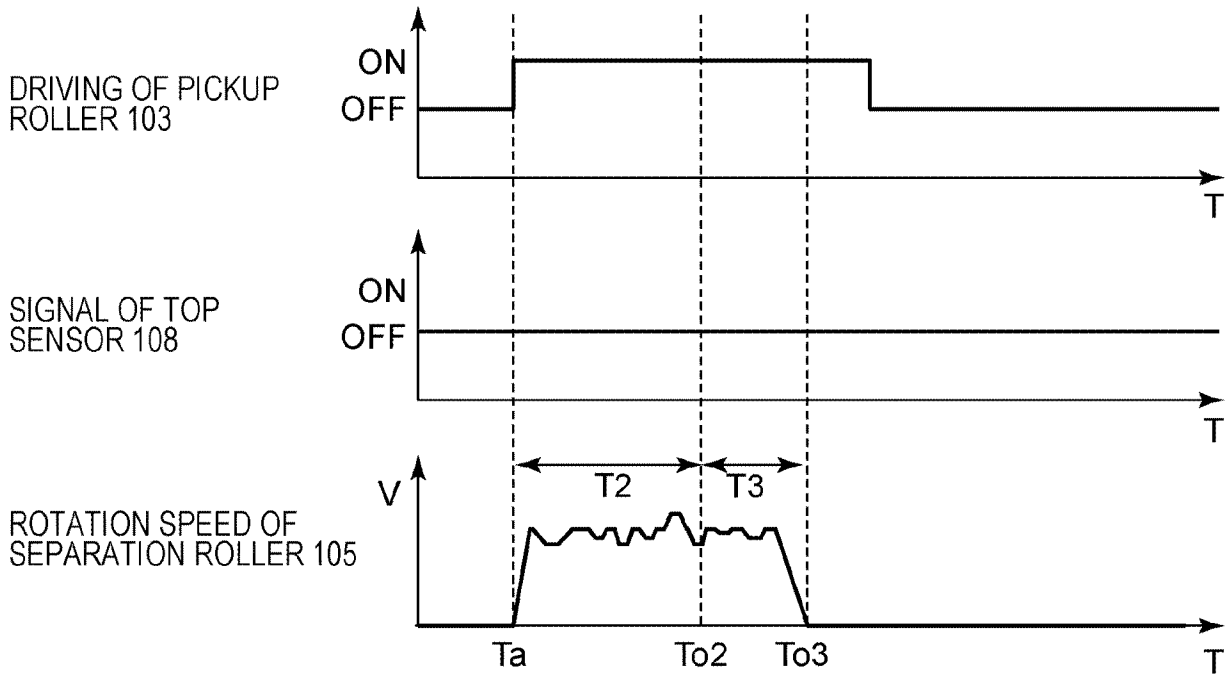

FIGS. 8A and 8B are diagrams illustrating an ON/OFF state of driving of a pick-roller 103, a signal waveform of a top sensor 108, and a rotation speed V of a separation roller 105 when sheet feeding control is executed in this embodiment and correspond to FIGS. 6A and 6B, respectively, of the first embodiment. This embodiment is characterized in that driving of the pick-roller 103, the feed roller 106, and the separation roller 105 is not brought into an OFF state at a timing To2 when sheet feeding failure occurs. When it is determined that conveyance failure has occurred at the timing To2, the driving remains in an ON state for determination of an access position. This is because rotation speed data of the separation roller 105 required for a determination of an access position without misdetection is collected. In this embodiment, a rotation speed of the separation roller 105 is measured in a period from the timing To2 to a timing To3 when a threshold time T3 has elapsed. Then a driving controller 210 maintains the driving of the pick-roller 103, the feed roller 106, and the separation roller 105 in the ON state and brings the driving into an OFF state at the timing To3.

Flowchart of Access Position Determination

A method for determining an access position at a time of jam clearance according to this embodiment will be described with reference to a flowchart of FIGS. 9A and 9B. Control based on the flowcharts of FIGS. 9A and 9B is executed by a CPU installed in an engine controller 201 in accordance with programs stored in a storage unit 209, such as a ROM.

Figure 9A:
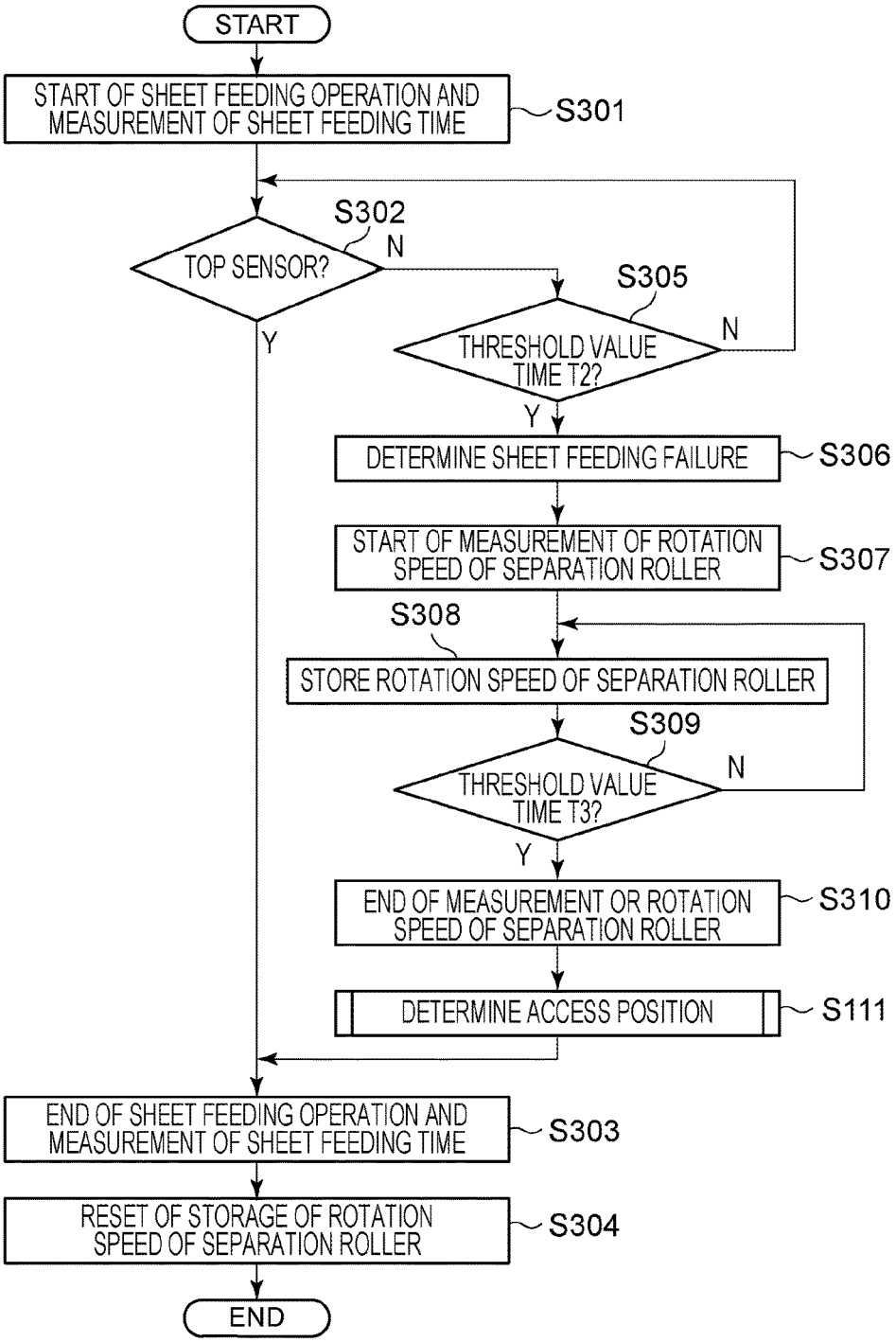
FIGS. 9A and 9B are flowcharts illustrating a determination of an access position according to the second embodiment.
Figure 9B:
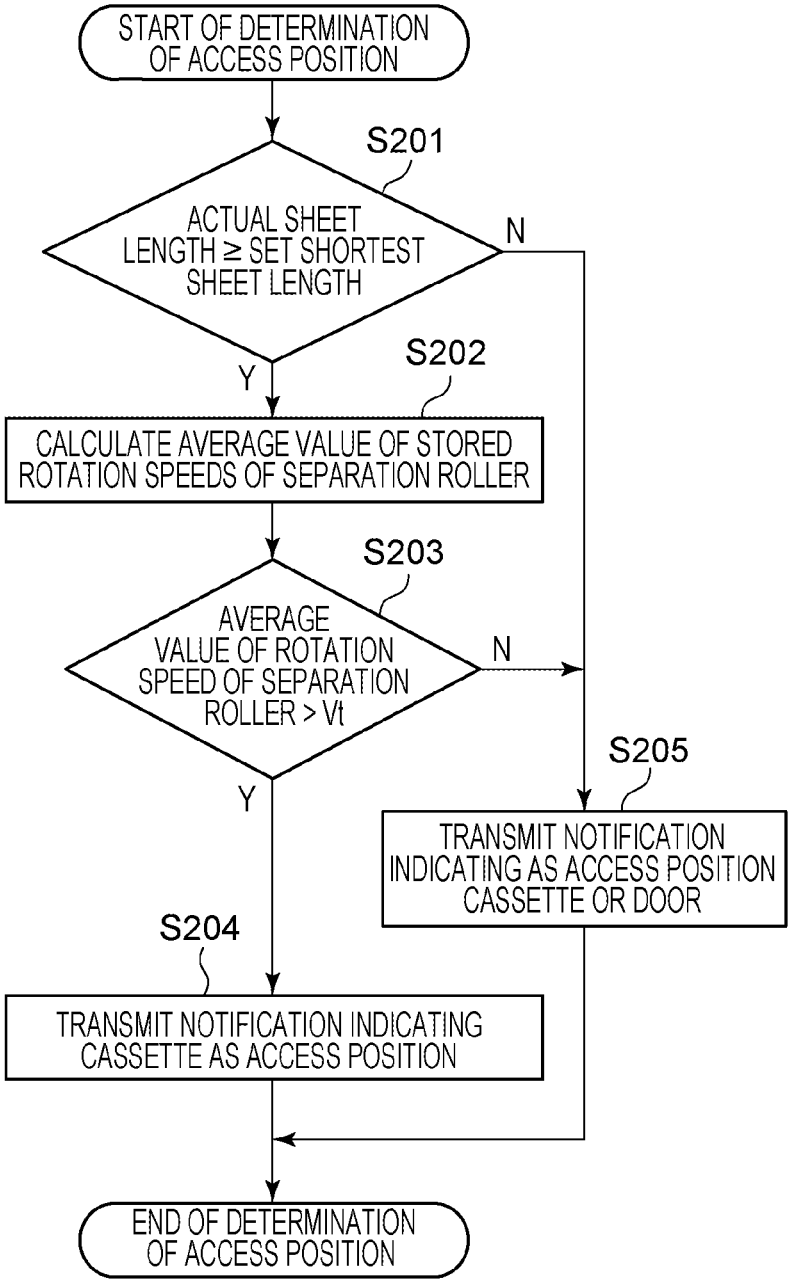

First, in FIG. 9A, the engine controller 201 transmits an instruction for starting sheet feeding to the driving controller 210 so as to start the sheet feeding operation. Simultaneously, a measurement unit 206 starts measurement of a sheet feeding time (S301). In step S302, the engine controller 201 determines whether the top sensor 108 has detected a sheet S1. When the determination is affirmative, the engine controller 201 causes the driving controller 210 to terminate the sheet feeding operation and causes the measurement unit 206 to terminate the measurement of the sheet feeding time (S303). In step S304, the storage unit 209 resets stored rotation speed data of the separation roller 105.

On the other hand, when the determination is negative in step S302, the engine controller 201 determines whether the sheet feeding time measured by the measurement unit 206 exceeds a threshold time T2 (S305). When the determination is negative, the engine controller 201 causes the driving controller 210 to continuously perform the sheet feeding operation. When the determination is affirmative, the determination unit 207 determines that the sheet feeding failure has occurred (S306). The measurement unit 206 starts measurement of the rotation speed of the separation roller 105 (S307), and the storage unit 209 stores the rotation speed of the separation roller 105 measured by the measurement unit 206 (S308). Thereafter, in step S309, the engine controller 201 determines whether a sheet feeding time after the sheet feeding failure is detected has exceeded a threshold time T3. When the determination is negative, the engine controller 201 causes the driving controller 210 to continuously perform the sheet feeding operation, causes the measurement unit 206 to continuously measure the rotation speed of the separation roller 105, and causes the storage unit 209 to continuously perform the storage. When the determination is affirmative, the determination unit 207 determines an access position for extracting the sheet S1 based on the rotation speed of the separation roller 105 stored in the storage unit 209 (S111). A subroutine in step S111 is the same as that of the first embodiment. The control for determination of an access position is thus terminated.

As described above, according to this embodiment, following effects may be attained in addition to the effects of the first embodiment. Specifically, even if a distance from a separation nip portion to the top sensor 108 on a conveying path is short or even if the sheet feeding speed of the sheets S is set high, misdetection for a determination of an access position is avoided and a position where the feeding failure has occurred may be accurately specified.

Note that, although the rotation speed of the separation roller 105 for a determination of an access position is an average value of data stored in the storage unit 209 according to the first and second embodiments, a center value, a largest value, or a smallest value of the data stored in the storage unit 209 may be employed.

Furthermore, although the output unit 208 displays the access position in the panel 211 according to the first and second embodiments described above, the present disclosure is not limited to this. For example, information on a selected access position may be transmitted to an external apparatus (an information processing apparatus, such as a PC) connected through a communication line so that the access point is displayed on a display of the external apparatus. Alternatively, light emitting diodes (LEDs) (light emitting units) may be individually disposed on the cassette 102 and the door 127 so that one of the LEDs corresponding to a selected access position may be emitted.

Although the sheets S are fed from the cassette 102 detachable from the body of the printer 101 according to the first and second embodiments described above, the present disclosure is not limited to this. The present disclosure is applicable to a configuration in which the sheets S are fed from a manual feed tray (not illustrated) which is not detachable from the body of the printer 101. Here, the manual feed tray indicates a mounting unit where the sheets S are mounted in a state in which the sheets S are exposed outside the body of the printer 101.

When the sheets S are fed from the manual feed tray, unlike the case of the cassette 102, a user may determine whether a jam sheet is stopped while striding the tray and the conveying path or a jam sheet is stopped while being accommodated in the tray without opening of the door 127. However, a case where the jam sheet which is stopped while being accommodated in the tray is not bent is difficult to be distinguished from a case where the sheets S are normally mounted on the tray. Therefore, the user may open the door 127 under a wrong impression that the jam sheet is positioned on the conveying path. According to this disclosure, such a burden of the user may be reduced.

Furthermore, according to the first and second embodiments described above, in the feeding operation described with reference to FIGS. 3A to 3E, the driving of the pick-roller 103 is turned OFF before the trailing end of the sheet S1 passes the pick-roller 103. However, the present disclosure is not limited to this. Since the encoder 203 is used to detect a rotation state of the separation roller 105, a smaller sheet interval (an interval between a trailing end of a preceding sheet and a leading end of a succeeding sheet) may be attained and productively may be improved.

Specifically, an ON state of the driving of the pick-roller 103 is maintained without performing switching to the OFF state before the trailing end of the sheet S1 passes the pick-roller 103. Then, after the trailing end of the sheet S1 has passed the pick-roller 103, the pick-roller 103 is in contact with a second sheet S2 following the sheet S1 and the sheet S2 is set as a preceding sheet to be fed. When a leading end of the sheet S2 reaches the separation nip portion in a state in which the sheet S1 is positioned in the separation nip portion, the separation roller 105 stops rotation or is rotated in the direction in which the sheet feeding is prevented as described above. When the change of the rotation state of the separation roller 105 is detected by the encoder 203 and the driving of the pick-roller 103 is switched to the OFF state, the leading end of the sheet S2 may be brought to the separation nip portion.

In the feeding operation described with reference to FIGS. 3A to 3E, positions of leading ends of the sheets S vary in an interval from the position Ps to the position Pfr, and therefore, the sheet interval may not be reduced to be smaller than this interval. However, if the feeding operation utilizing the encoder 203 is executed, the sheet interval may be reduced to be smaller than this interval, and productivity is improved.

Modification

Figure 10:
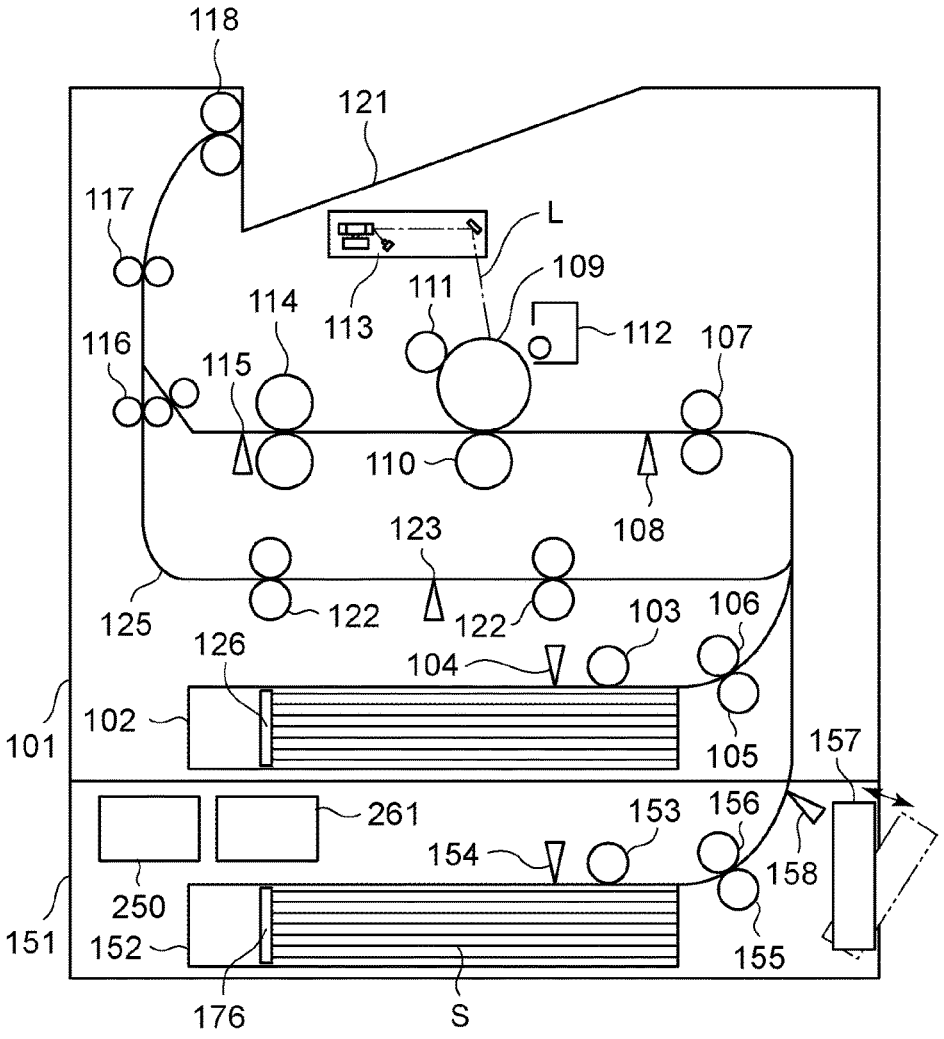
FIG. 10 is a diagram schematically illustrating a configuration of a sheet feeding option according to a modification example.

According to the first and second embodiments described above, the control unit 200 is mounted on the printer 101. However, the present disclosure is not limited to this. An option controller 250 may be mounted on a sheet feeding option 151 which is detachable from a printer 101 as illustrated in FIG. 10. Then the option controller 250 may execute the control described above.

A cassette 152 is an accommodation unit which accommodates sheets S (recording materials) and is detachable from a body of the sheet feeding option 151. A rear-end regulating plate 176 disposed in the cassette 152 regulates rear ends (ends on an upstream side in a feeding direction) of the sheets S accommodated in the cassette 152. The rear-end regulating plate 176 is movable in the feeding direction and is disposed in a regular position corresponding to a size (a length in the feeding direction) of the sheets S so that the sheets S are set in an appropriate position.

A pickup roller 153 (hereinafter referred to as a pick-roller 153) feeds (conveys) the sheets S accommodated in the cassette 152 in a state in which the cassette 152 is attached to the body of the sheet feeding option 151. Each of the sheets S which is fed by the pick-roller 153 is supplied to a downstream side by a feed roller 156 and reaches a top sensor 108 through an option sensor 158 and a registration-roller pair 107. A separation roller 155 forms a separation nip portion with the feed roller 156 so as to prevent a plurality of the sheets from being supplied to the downstream side relative to the separation nip portion. Operation of the separation roller 155 is the same as that of the separation roller 105. By this, only one of the sheets S accommodated in the cassette 152 which is positioned in an uppermost portion in a vertical direction is fed to the registration-roller pair 107.

Furthermore, a sheet detection sensor 154 determines whether a sheet S is accommodated in the cassette 152. The sheet feeding option 151 includes an operation panel 261 (hereinafter referred to as a panel 261) which displays various information for a user. The sheet feeding option 151 further includes a door 157 which is openable relative to the apparatus body. The user may access a conveying path on the downstream side in the sheet feeding direction relative to the separation nip unit by opening the door 157. Note that a driving configuration of the sheet feeding option 151 is the same as that of the printer 101 illustrated in FIG. 25.

Figure 11:
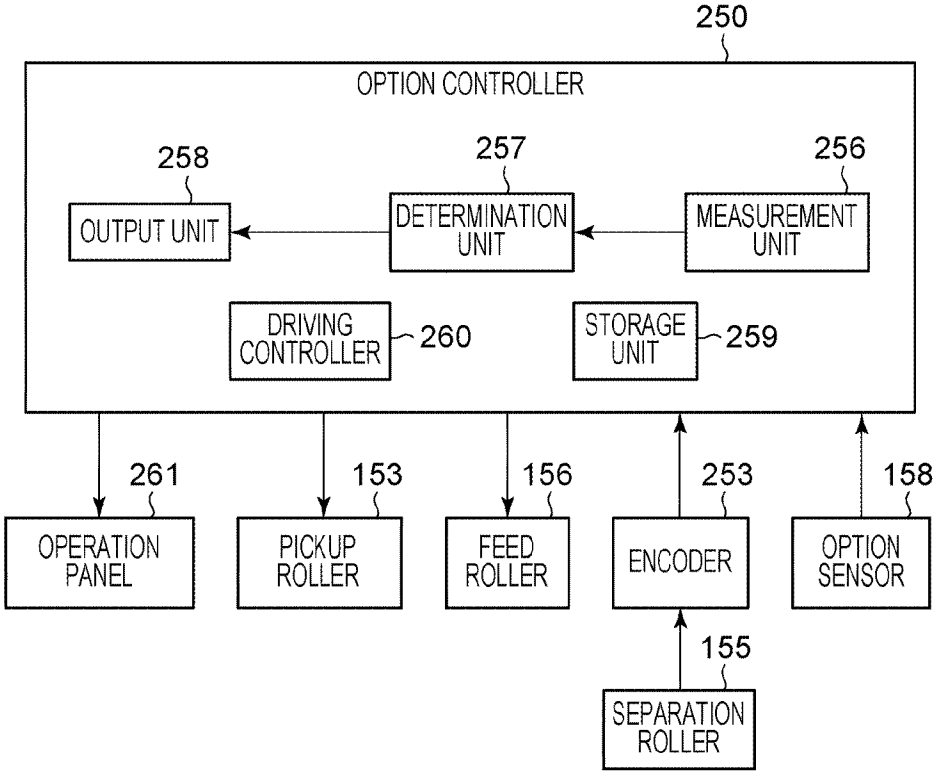
FIG. 11 is a block diagram illustrating control of the sheet feeding option according to the modification example.

FIG. 11 is a block diagram illustrating control of the option controller 250. The option controller 250 includes a measurement unit 256, a determination unit 257, an output unit 258, a storage unit 259, and a driving controller 260. Furthermore, an encoder 253 and an option sensor 158 which detect a rotation state of the separation roller 155 are connected to the option controller 250. When driving of the pick-roller 153 is controlled by the driving controller 260, results of detection of the sensors are used. In the modification example, when the top sensor 108 according to the foregoing embodiment is replaced by the option sensor 158, the same control may be executed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-053523 filed Mar. 17, 2017, which is hereby incorporated by reference herein in its entirety.

What is claimed is:

1. A feeding apparatus comprising:

a feeding rotary member configured to feed a recording material accommodated in an accommodation unit;

a conveying rotary member pair configured to convey the recording material fed by the feeding rotary member, wherein the conveying rotary member pair includes first and second rotary members which form a nip portion and the recording material is conveyed while being nipped in the nip portion;

an output unit configured to output a state signal in accordance with a rotation state of the second rotary member;

a detection unit configured to determine whether the recording material has reached a position on a downstream side relative to the nip portion in a feeding direction of the recording material; and a control unit configured to stop the feeding operation in a case where the detection unit does not detect the recording material by the time when a threshold time has elapsed after the feeding operation is started on the recording material by the feeding rotary member and the conveying rotary member pair, wherein the control unit determines that the recording material is stopped at a position on an upstream side relative to the nip portion in the feeding direction in a case where a rotation speed of the second rotary member, indicated by the state signal output from the output unit at least in a period of time from when a period of time required for the recording material to reach the nip portion has elapsed to when the feeding operation is stopped, is faster than a threshold speed.

2. The feeding apparatus according to claim 1, wherein, when determining that the recording material is stopped at the position on the upstream side relative to the nip portion in the feeding direction, the control unit transmits a notification indicating that the accommodation unit corresponds to an access position for extracting the stopped recording material out of an apparatus body of the feeding apparatus.

3. The feeding apparatus according to claim 1, wherein, when determining that the recording material is stopped at the position on the upstream side relative to the nip portion in the feeding direction, the control unit restarts the feeding operation.

4. The feeding apparatus according to claim 1, wherein, when the rotation speed of the second rotation body indicated by the state signal output from the output unit in the period is slower than the threshold speed, the control unit determines that the recording material is stopped in a state in which the recording material strides the nip portion.

5. The feeding apparatus according to claim 4, further comprising:

a door which is openable and closable relative to the apparatus body of the feeding apparatus, wherein a conveying path on a downstream side relative to the nip portion in the feeding direction is accessible when the door is opened, wherein, when it is determined that the recording material is stopped in the state in which the recording material strides the nip portion, the control unit transmits a notification indicating that the door corresponds to the access position for extracting the stopped recording material out of the apparatus body.

6. The feeding apparatus according to claim 1, wherein the control unit performs a process of determining a position of the stopped recording material when a length of the recording material accommodated in the accommodation unit in the feeding direction is longer than a predetermined length and does not perform the determination process when the length of the recording material is shorter than the predetermined length.

7. The feeding apparatus according to claim 6, wherein the predetermined length is longer than at least a distance from the nip portion to the detection unit on the conveying path.

8. The feeding apparatus according to claim 1, wherein the control unit performs a process of determining a position of the stopped recording material when the recording material accommodated in the accommodation unit is a predetermined type, whereas the control unit does not perform the determination process when the recording material is not the predetermined type.

9. The feeding apparatus according to claim 8, wherein the control unit performs the determination process when the type of the recording material indicates a standard sheet whereas the control unit does not perform the determination process when the type of the recording material indicates a thin sheet which is thinner than the standard sheet.

10. The feeding apparatus according to claim 1, wherein the second rotary member is a separation rotary member which is rotated in a predetermined direction by a single recording material when the single recording material is fed to the nip portion and which is stopped or rotated in a direction opposite to the predetermined direction so as to separate a plurality of recording materials to obtain a single recording material when the plurality of recording materials are fed to the nip portion in an overlapping manner.

11. The feeding apparatus according to claim 1, wherein the control unit determines that the recording material is stopped at the position on the upstream side relative to the nip portion in the feeding direction when an average speed of rotation speeds of the second rotary member in the period is faster than the threshold speed.

12. The feeding apparatus according to claim 1, wherein the control unit continues an operation of feeding a recording material for a predetermined period of time when the detection unit does not detect a recording material before the threshold time has elapsed.

13. The feeding apparatus according to claim 1, further comprising:

a driving source configured to drive the feeding rotary member and the first and second rotary members; and a switching unit configured to transmit driving force from the driving source to the feeding rotary member and the first and second rotary members or block the driving force.

14. The feeding apparatus according to claim 1, wherein the output unit includes a light emission unit, a code wheel which is disposed coaxially with the second rotary member and which is rotated along with the second rotary member, and a photosensor which outputs different signals depending on a result of a determination as to whether light which has been emitted from the light emission unit and which has passed a slit formed on the code wheel is detected or not detected.

15. A feeding apparatus comprising:

a feeding rotary member configured to feed a recording material accommodated in an accommodation unit;

a conveying rotary member pair configured to convey the recording material fed by the feeding rotary member, wherein the conveying rotary member pair includes first and second rotary members which form a nip portion and the recording material is conveyed while being nipped in the nip portion;

an output unit configured to output a state signal in accordance with a rotation state of the second rotary member;

a detection unit configured to determine whether the recording material has reached a position on a downstream side relative to the nip portion in a feeding direction of the recording material; and a control unit configured to stop the feeding operation in a case where the detection unit does not detect the recording material by the time when a threshold time has elapsed after the feeding operation is started on the recording material by the feeding rotary member and the conveying rotary member pair, wherein the control unit transmits a notification indicating that the accommodation unit corresponds to an access position for extracting the stopped recording material out of an apparatus body of the feeding apparatus in a case where a rotation speed of the second rotary member, indicated by the state signal output from the output unit at least in a period of time from when a period of time required for the recording material to reach the nip portion to when the feeding operation is stopped, is faster than a threshold speed.

16. The feeding apparatus according to claim 15, further comprising:

a door which is operable and closable relative to the apparatus body of the feeding apparatus, wherein a conveying path on the downstream side relative to the nip portion in the feeding direction is accessible when the door is opened, wherein the control unit transmits a notification indicating that the door corresponds to the access position for extracting the stopped recording material out of the apparatus body in a case where the rotation speed of the second rotary member indicated by the state signal output from the output unit in the period is slower than the threshold speed.

17. The feeding apparatus according to claim 15, wherein the control unit transmits the notification indicating the access position by displaying a message or an image in a display unit, transmits the notification indicating the access position to an information processing apparatus connected to the feeding apparatus through a communication line, or transmits the notification indicating the access position by emitting light from the light emission unit included in the accommodation unit.

18. A feeding apparatus comprising:

a feeding rotary member configured to feed a recording material accommodated in an accommodation unit;

a conveying rotary member pair configured to convey the recording material fed by the feeding rotary member, wherein the conveying rotary member pair includes first and second rotary members which form a nip portion and the recording material is conveyed while being nipped in the nip portion;

an output unit configured to output a state signal in accordance with a rotation state of the second rotary member;

a detection unit configured to determine whether the recording material has reached a position on a downstream side relative to the nip portion in a feeding direction of the recording material; and a control unit configured to stop the feeding operation in a case where the detection unit does not detect a recording material by the time when a threshold time has elapsed after the feeding operation is started on the recording material by the feeding rotary member and the conveying rotary member pair, wherein the control unit determines that the recording material is stopped at a position on an upstream side relative to the nip portion in the feeding direction in a case where a period of time, in which a state in which a rotation speed of the second rotary member indicated by the state signal output from the output unit is faster than a threshold speed is continued, is longer than a threshold time.

19. The feeding apparatus according to claim 18, wherein the control unit determines that the recording material is stopped in a state in which the recording material strides the nip portion in a case where the period of time, in which the rotation speed of the second rotary member indicated by the state signal output from the output unit in the period is faster than the predetermined speed is continued, is shorter than the threshold time.

20. The feeding apparatus according to claim 18, wherein the second rotary member is a separation rotary member which is rotated in a predetermined direction by a single recording material when the single recording material is fed to the nip portion and which is stopped or rotated in a direction opposite to the predetermined direction so as to separate a plurality of recording materials to obtain a single recording material when the plurality of recording materials are fed to the nip portion in an overlapping manner.

* * * * *